US010433599B2

(12) United States Patent
Paas

(10) Patent No.: US 10,433,599 B2
(45) Date of Patent: Oct. 8, 2019

(54) SYSTEM FOR ASSOCIATING AN ARTICLE OF CLOTHING PERSONALIZED ACCORDING TO A TRAVEL HISTORY

(71) Applicant: Matthew Paas, Grand Rapids, MI (US)

(72) Inventor: Matthew Paas, Grand Rapids, MI (US)

( * ) Notice: Subject to any disclaimer, the term of this patent is extended or adjusted under 35 U.S.C. 154(b) by 270 days.

(21) Appl. No.: 15/399,113

(22) Filed: Jan. 5, 2017

(65) Prior Publication Data

US 2017/0112207 A1 Apr. 27, 2017

Related U.S. Application Data

(63) Continuation of application No. 13/720,056, filed on Dec. 19, 2012, now abandoned, which is a continuation-in-part of application No. 12/321,327, filed on Jan. 20, 2009, now abandoned.

(51) Int. Cl.

| | |
|---|---|
| ***A41D 27/06*** | (2006.01) |
| ***A41D 27/08*** | (2006.01) |
| ***G09F 21/02*** | (2006.01) |

(52) U.S. Cl.

CPC ..... *A41D 27/08* (2013.01); *G09F 21/02* (2013.01)

(58) Field of Classification Search

CPC .... A41D 27/08; G09F 21/02; G09F 2021/023
USPC ..... 2/69, 544; 40/586; 424/150, 147; 380/59

See application file for complete search history.

(56) References Cited

U.S. PATENT DOCUMENTS

| | | | |
|---|---|---|---|
| 730,859 | A | 6/1903 | Austin |
| 2,685,690 | A | 8/1954 | Chrisman |
| 3,316,669 | A | 5/1967 | Nachbar |
| 3,495,833 | A | 2/1970 | Wesley |
| 3,849,913 | A | 11/1974 | Williams, Sr. |
| 4,194,305 | A | 3/1980 | Smith et al. |
| 4,354,282 | A | 10/1982 | Langdon |
| 4,476,381 | A | 10/1984 | Rubin |
| 4,650,219 | A | 3/1987 | Sigman |
| 4,776,043 | A | 10/1988 | Coleman |
| 4,860,387 | A | 8/1989 | Williams |
| 4,937,181 | A | 6/1990 | Rogers |
| 4,966,815 | A | 10/1990 | Hare |
| 5,070,545 | A | 12/1991 | Tapia |
| 5,121,505 | A | 6/1992 | Ludmer et al. |
| 5,259,763 | A | 11/1993 | Wendel et al. |
| 5,423,574 | A | 6/1995 | Forte-Pathroff |
| 5,454,600 | A | 10/1995 | Floyd |
| 5,496,176 | A | 3/1996 | Swanson |
| 5,509,144 | A | 4/1996 | Soergel et al. |
| 5,549,332 | A | 8/1996 | Judson |
| 5,570,081 | A | 10/1996 | Holstrom |
| 5,734,991 | A | 4/1998 | Schmid |

(Continued)

*Primary Examiner* — Alissa L Hoey
(74) *Attorney, Agent, or Firm* — McGarry Bair PC

(57) ABSTRACT

An article of clothing can be personalized with indicia communicating a travel history of a person wearing the article of clothing. A unique identifier can be assigned to the person wearing the article of clothing and displayed on the article of clothing. Further, the unique identifier can correspond to a data record on a database, and the data record can comprise information related to the travel history of the person wearing the article of clothing. The information in the data record can be accessed, such as through a social network interface, to associate the information with the person wearing the article of clothing.

17 Claims, 12 Drawing Sheets

(56) References Cited

U.S. PATENT DOCUMENTS

| | | | | |
|---|---|---|---|---|
| 5,742,940 | A | 4/1998 | Sparks | |
| 5,794,267 | A | 8/1998 | Wallace | |
| 5,800,182 | A | 9/1998 | Carson et al. | |
| 5,813,051 | A | 9/1998 | Counter | |
| 5,845,334 | A | 12/1998 | Marcolini, Jr. | |
| 5,933,866 | A | 8/1999 | Fox | |
| 5,933,873 | A | 8/1999 | Curran et al. | |
| 5,964,354 | A | 10/1999 | Skinner | |
| 5,979,941 | A | 11/1999 | Mosher, Jr. et al. | |
| 6,038,698 | A | 3/2000 | Lawler | |
| 6,064,307 | A | 5/2000 | Silver | |
| 6,185,746 | B1 | 2/2001 | Scott | |
| 6,264,025 | B1 | 7/2001 | Kennedy | |
| 6,314,581 | B1 | 11/2001 | Bond | |
| 6,397,390 | B1 | 6/2002 | Henderson et al. | |
| 6,412,626 | B2 * | 7/2002 | Krull | A47G 1/12 206/8 |
| 6,481,134 | B1 | 11/2002 | Aledo | |
| 6,554,130 | B1 * | 4/2003 | Krull | G09B 19/0061 206/8 |
| 6,622,923 | B1 | 9/2003 | Walmsley et al. | |
| 6,661,433 | B1 | 12/2003 | Lee | |
| 6,751,805 | B1 | 6/2004 | Austion | |
| 6,769,139 | B1 | 8/2004 | Goldkind | |
| 6,782,554 | B1 | 8/2004 | Froehlich | |
| 6,810,529 | B1 | 11/2004 | Reilly et al. | |
| 6,982,115 | B2 | 1/2006 | Poulos et al. | |
| 7,005,170 | B1 | 2/2006 | Simpson et al. | |
| 7,233,240 | B2 | 6/2007 | Phillips | |
| 7,571,495 | B2 | 8/2009 | Emeth | |
| 7,725,955 | B1 | 6/2010 | Johnson | |
| 7,784,703 | B2 | 8/2010 | Walmsley et al. | |
| 7,805,871 | B2 | 10/2010 | Ciarrocchi | |
| 8,490,307 | B2 | 7/2013 | Landsman et al. | |
| 2001/0034588 | A1 | 10/2001 | Agrawals et al. | |
| 2002/0030638 | A1 | 3/2002 | Weiner | |
| 2002/0078609 | A1 | 6/2002 | Leb | |
| 2004/0068778 | A1 | 4/2004 | Van Veghel et al. | |
| 2004/0187184 | A1 | 9/2004 | Rubin et al. | |
| 2005/0137791 | A1 | 6/2005 | Agrawala et al. | |
| 2005/0287500 | A1 | 12/2005 | Hubbard | |
| 2006/0064309 | A1 | 3/2006 | Leonitta King | |
| 2007/0050880 | A1 | 3/2007 | Weisman et al. | |
| 2007/0150091 | A1 | 6/2007 | Griffits | |
| 2007/0212669 | A1 | 9/2007 | Counts et al. | |
| 2009/0117531 | A1 | 5/2009 | Yoon | |
| 2010/0009703 | A1 | 1/2010 | Sornay | |
| 2010/0017932 | A1 | 1/2010 | Egglesfield | |
| 2010/0030710 | A1 | 2/2010 | Pulver | |
| 2010/0058510 | A1 | 3/2010 | Vithlani | |
| 2010/0095571 | A1 | 4/2010 | James | |
| 2010/0101004 | A1 | 4/2010 | Ragsdale, III | |
| 2010/0192433 | A1 | 8/2010 | Lewis | |
| 2011/0099684 | A1 | 5/2011 | Kane | |
| 2012/0041814 | A1 | 2/2012 | Kraft | |
| 2012/0085829 | A1 | 4/2012 | Ziegler | |
| 2014/0258020 | A1 | 9/2014 | Greene | |
| 2014/0359914 | A1 | 12/2014 | Meyer | |
| 2015/0096108 | A1 | 4/2015 | Almeda, Jr. | |
| 2015/0189934 | A1 | 7/2015 | Powell | |

* cited by examiner

SYSTEM FOR ASSOCIATING AN ARTICLE OF CLOTHING PERSONALIZED ACCORDING TO A TRAVEL HISTORY

CROSS-REFERENCE TO RELATED APPLICATION

This application is a continuation of U.S. patent application Ser. No. 13/720,056, filed Dec. 19, 2012, which is a continuation-in-part of U.S. patent application Ser. No. 12/321,327, filed Jan. 20, 2009, both of which are incorporated herein by reference in its entirety.

BACKGROUND

Many people enjoy traveling, not only to various locations within a state or various states within a country, but also around the world. Friends and family members often share their travel experiences with each other, such as by sharing pictures and telling stories about events that occurred while traveling. Travel can also be a uniting subject that brings together strangers having common travel histories or interests in traveling to the same locations. Social networking and other internet-related media outlets can provide ways for people to connect and share travel information.

BRIEF DESCRIPTION OF THE INVENTION

In one aspect, the disclosure relates to a system for associating an article of clothing personalized according to a travel history, including a first article of clothing having at least one first indicium in the form of a map displayed on the first article of clothing and personalized to provide a travel history of a person associated with the first article of clothing, and a first identifier disposed on the first article of clothing, a second article of clothing having at least one second indicium in the form of a map displayed on the second article of clothing and personalized to provide a travel history of a person associated with the second article of clothing, and a second identifier disposed on the second article of clothing, a first data record corresponding to the first article of clothing and a second data record corresponding to the second article of clothing and where the first data record and the second data record are configured to associate the respective identifier with the travel history of the corresponding person, and a database configured to store the first data record and the second data record and to allow access to at least one of the first data record or the second data record through the corresponding identifier. The first identifier and second identifier are unique.

In another aspect, the disclosure relates to a system for associating an article of clothing personalized according to a travel history, including at least two articles of clothing. Each of the at least two articles of clothing further includes a base indicium layer, at least one personalized indicium connected relative to the base indicium layer configured to represent a travel history of a person associated with the respective article of clothing, and an identifier unique to the respective article of clothing and disposed on the respective article of clothing. The system further includes at least two electronic data records configured to associate the respective unique identifier of the at least two articles of clothing with the travel history of the person associated with the respective article of clothing, and a database configured to store the at least two electronic data records and to allow access to the electronic data records In yet another aspect, the disclosure relates to a system for associating an article of clothing personalized according to a travel history, including a first article of clothing having a first identifier, a first data record corresponding with the first article of clothing by way of the first identifier, a second article of clothing having a second identifier, a second data record corresponding with the second article of clothing by way of the second identifier, and a database configured for storing data records. Each of the first data record and the second data record and the associated article of clothing include a personalized travel history for a person associated with the respective article of clothing.

BRIEF DESCRIPTION OF THE DRAWINGS

In the drawings:

FIG. 11 is a front elevation view of an article of clothing similar to that of FIG. 1 showing states of the United States which have been traveled to by an individual by displaying only the states that have been traveled to without an outline of the states not traveled to.

DESCRIPTION OF EMBODIMENTS OF THE INVENTION

Figure 1:
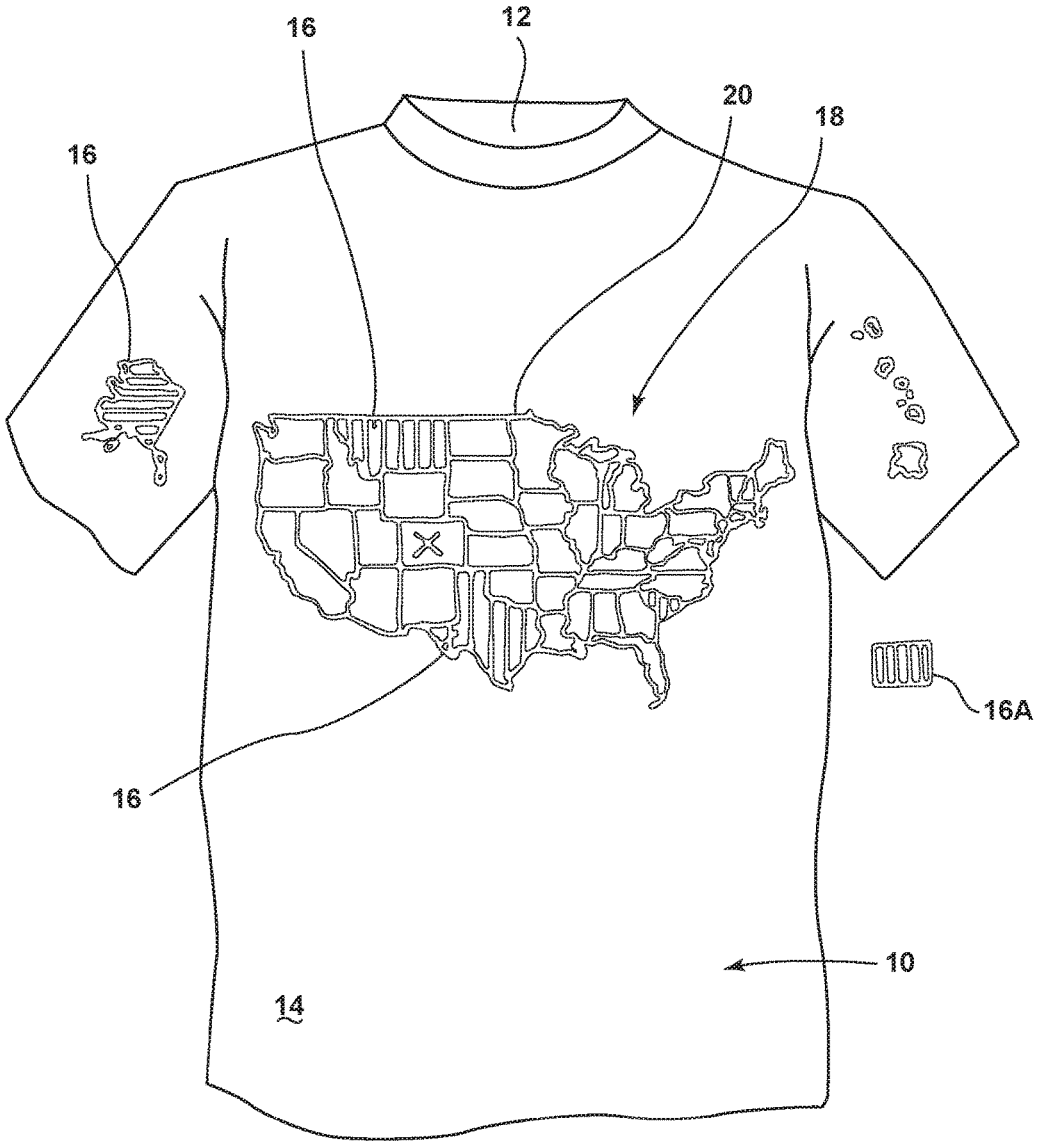
FIG. 1 is a front elevation view of an article of clothing having personalized indicia according aspects of the present disclosure.
Figure 2:
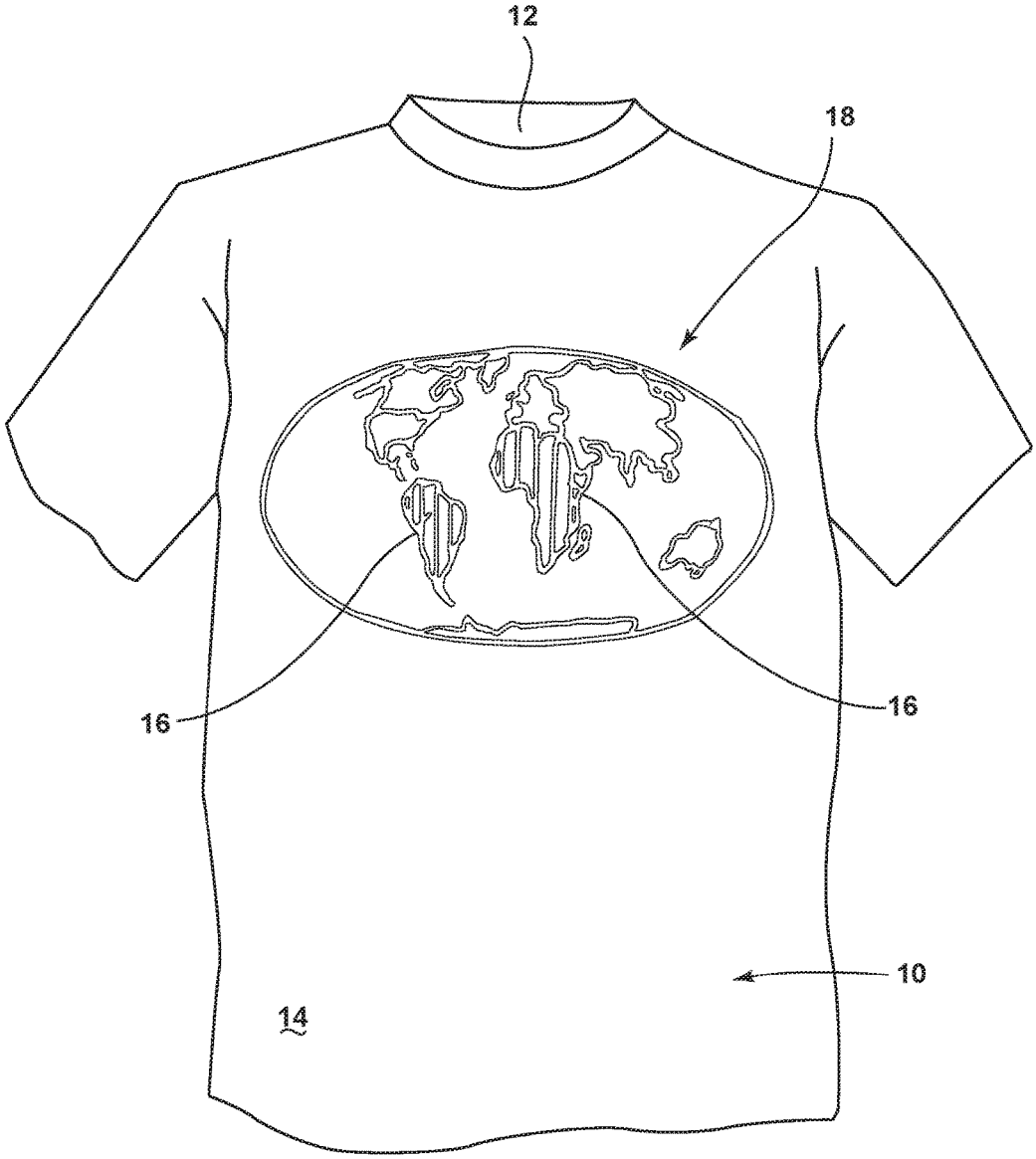
FIG. 2 is a front elevation view of an article of clothing having personalized indicia according to aspects of the present disclosure.
Figure 3:
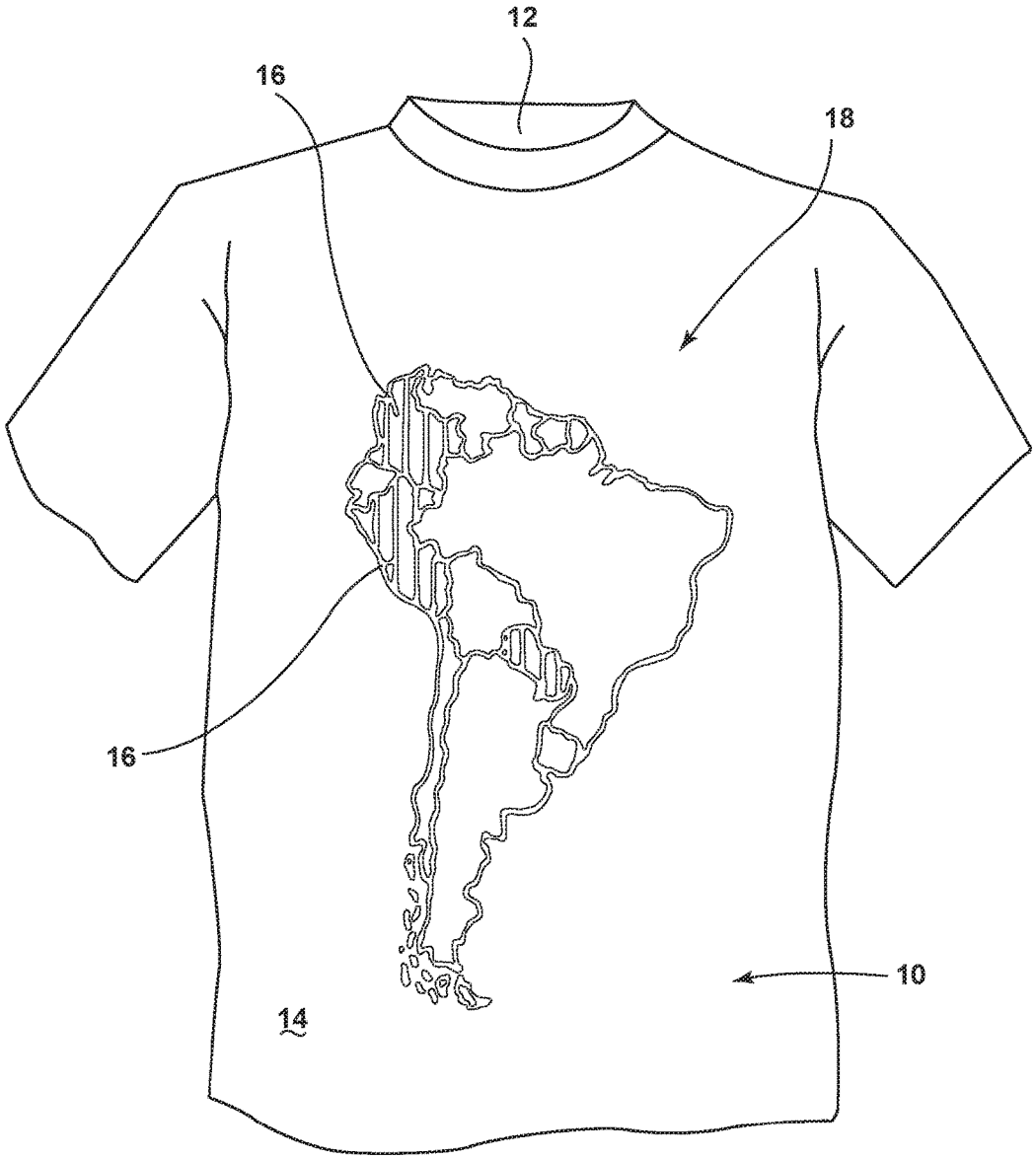
FIG. 3 is a front elevation view of an article of clothing having personalized indicia according to aspects of the present disclosure.

Referring now to the drawings, and to FIGS. 1-6 collectively, a personalized article of clothing 10 is shown as comprising an inner surface 12 and an outer surface 14 having a personalized indicium 16 or a plurality of the personalized indicium 16 (i.e., personalized indicia, and hereinafter referred to as "personalized indicia" with the understanding that, unless stated otherwise, "personalized indicia" is intended to mean one or more than one indicium, for simplicity). In general, the article of clothing 10 may comprise, for example, a t-shirt, tank top, long sleeve shirt, sweat shirt, pair of trousers, coat, hat, purse, and the like. It will be understood that the articles of clothing may be fabricated from any suitable material, including, cotton, polyester, hemp, fur, leather, and denim, just to name a few.

In one exemplary aspect, and as is best shown in FIG. 1, the article of clothing 10 may comprise a base indicium 18 or a plurality of the base indicium 18 (i.e., base indicia, and hereinafter referred to as "base indicia" with the understanding that, unless stated otherwise, "base indicia" is intended to mean one or more than one indicium, for simplicity). The base indicia 18 may include text or graphics, for example, a planet, continent, country, state, territory, province, city, county, region, etc. The base indicia 18 may be permanently or removably attached to or associated with the article of clothing 10 by, for example, a thermally activated adhesive (e.g., iron-on indicia) disposed on the base indicia 18. In one embodiment, the base indicia 18 is placed upon the article of clothing 10, and the adhesive is activated via application of heat. Although, it will be understood that base indicia 18 may also be embroidered and/or stitched via a sewing machine or by hand onto the article of clothing 10. Moreover, the base indicia 18 may be silk-screened and/or absorbed into/onto the article of clothing 10 using inks, paints and/or fabric dyes. In one embodiment, the base indicia 18 may optionally include an outline 20 disposed on the article of clothing 10. It will be understood that the article of clothing 10 may or may not include the base indicia 18.

The personalized indicia 16 and the base indicia 18 may be fabricated from, for example, a durable material such as a textile or a polymer, although any one of a number of durable materials that would be known to one having ordinary skill in the art are likewise contemplated for use in accordance with the present disclosure. Both the personalized indicia 16 and the base indicia 18 may comprise, for example, text, a reflective material, photos, images, colors or patterns of colors, and the like. Furthermore, the personalized indicia 16 and the base indicia 18 may optionally comprise a substantially flat or partially raised profile so as to provide texturing.

In one embodiment, the base indicia 18 may also comprise a series of hooks and/or loops fabricated so as to receive a corresponding series of hooks and/or loops disposed on the personalized indicia 16 so as to form a releasable connection therebetween. In another embodiment, the base indicia 18 may also comprise a magnetic surface fabricated so as to receive a second magnetic surface disposed on the personalized indicia 16 so as to form a releasable connection therebetween. The personalized indicia 16 allows a user to change the aesthetic appearance of the article of clothing 10 and can, therefore, also be thought of as customizable indicia. It will be understood that the personalized indicia 16 may be permanently or releasably connected to the article of clothing 10 via the same methods as disclosed for securing the personalized indicia 16 to the base indicia 18 and for disposing the base indicia 18 on the article of clothing 10.

Referring now to FIG. 1, and by way of non-limiting example, the illustrated article of clothing 10 includes the base indicia 18 comprising a map outlining the United States of America and further outlining individual states. The personalized indicia 16 includes several of the indicium having the size and shape of the individual states outlined on the map. Furthermore, the personalized indicia 16 may comprise a color so as to distinguish the personalized indicia 16 from the article of clothing 10 and/or the base indicia 18. The personalized indicia 16, comprising individual states in the present example, may be placed upon the corresponding areas of the map. For example, a removable indicium 16A is shown removed from the article of clothing 10. The removable indicium 16A is shown as corresponding to the State of Colorado and may preferably be placed upon the base indicia 18 in location X. In one example, the personalized indicia 16 may be utilized to display the states to which the user has traveled. Connections, as discussed above, for example, magnets and/or hook and loop fasteners, may operate to releasably secure the personalized indicia 16 with the article of clothing 10 and/or the base indicia 18.

In an aspect of the present disclosure, the article of clothing 10 may have the personalized indicia 16 that pertains to desired travel history or actual travel history of an individual. The desired travel history may be a travel history that the person wearing the article of clothing 10 desires to communicate via the personalized indicia 16 and may correspond to locations to which the person would like to travel alone or in combination with locations to which the person has traveled, i.e., the actual travel history. In such an embodiment, the article of clothing 10 may have the inner surface 12 and the outer surface 14, wherein the outer surface 14 comprises an area (e.g., the front, back, and/or sleeves), and the personalized indicia 16 may be associated with the area, wherein the personalized indicia 16 corresponds to a desired location or location traveled to or on by the individual, and further wherein the personalized indicia 16 operates to change the appearance of the article of clothing 10 relative to the same without the personalized indicia 16.

In an aspect of the present disclosure, the personalized indicia 16 may be the same or different and comprise at least one of a continent, country, state, territory, province, city, county, township, village, reservation, ocean, lake, river, stream, harbor, port, wonder of the world, landmark, park, hiking trail, ski lodge, golf course, bridge, stadium, track, museum, gallery, store, restaurant, watering hole, highway, station, airport, and combinations thereof. It will be further understood that the personalized indicia 16 may comprise the same or different color of another piece of personalized indicia associated with the article of clothing 10. For example, the personalized indicia 16 may consist of states of the United States, countries of Europe, and/or cities on the planet Earth, just to name a few.

Figure 4:
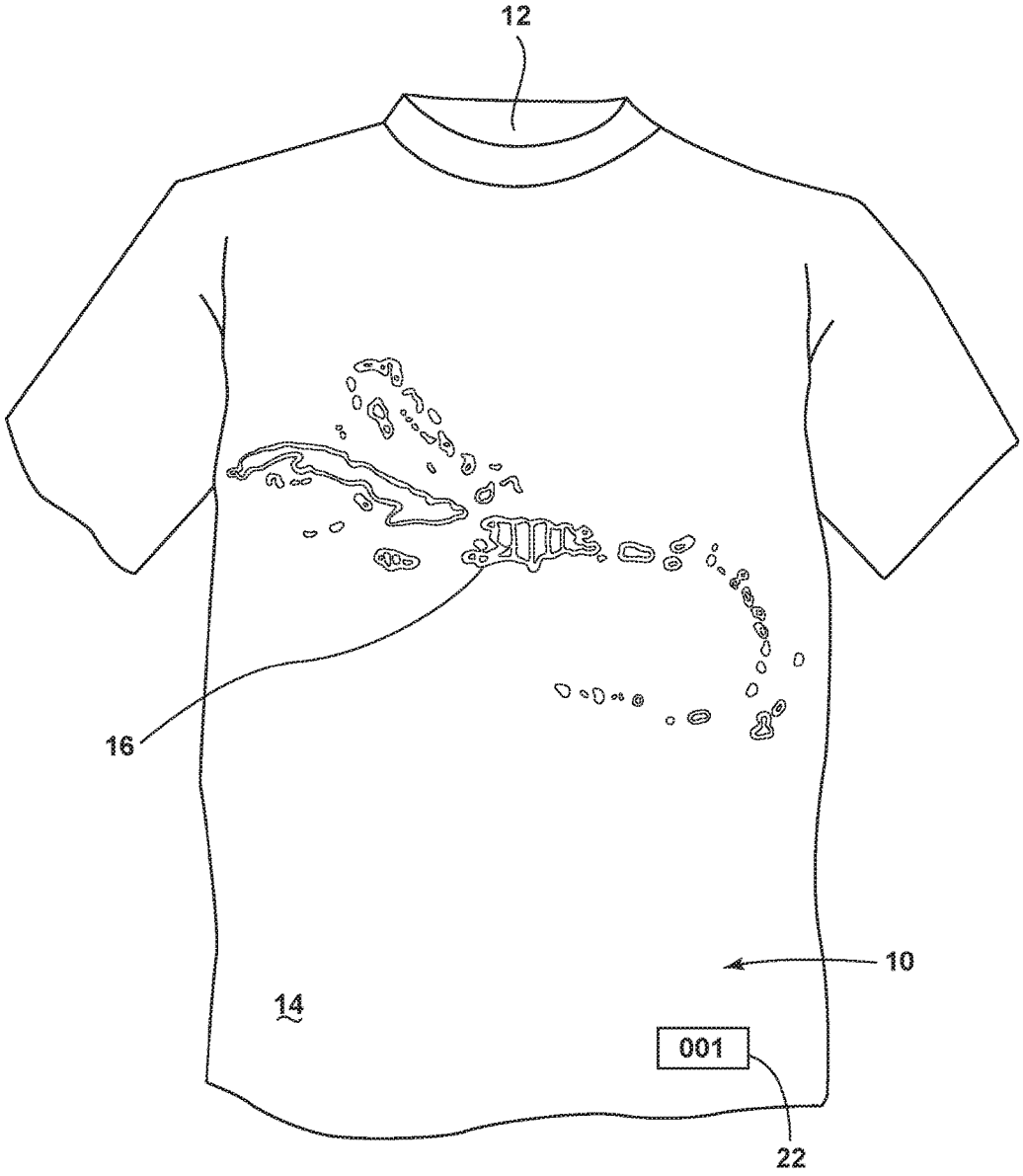
FIG. 4 is a front elevation view of an article of clothing having personalized indicia according to aspects of the present disclosure, showing various island states which have been traveled to by an individual, as well as a unique identifier.
Figure 5:
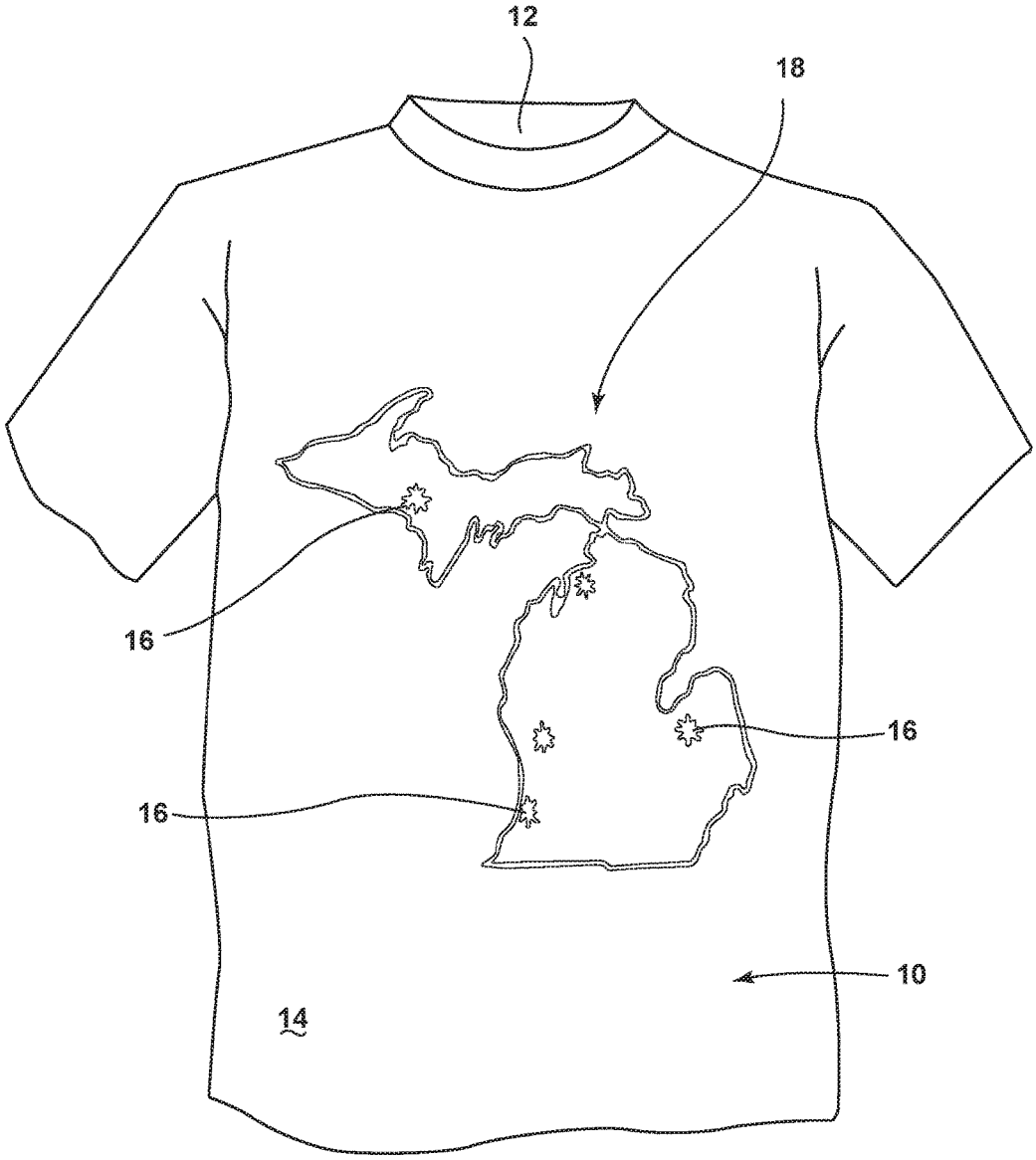
FIG. 5 is a front elevation view of an article of clothing having personalized indicia according to aspects of the present disclosure, showing the state parks of Michigan which have been traveled to by an individual.
Figure 6:
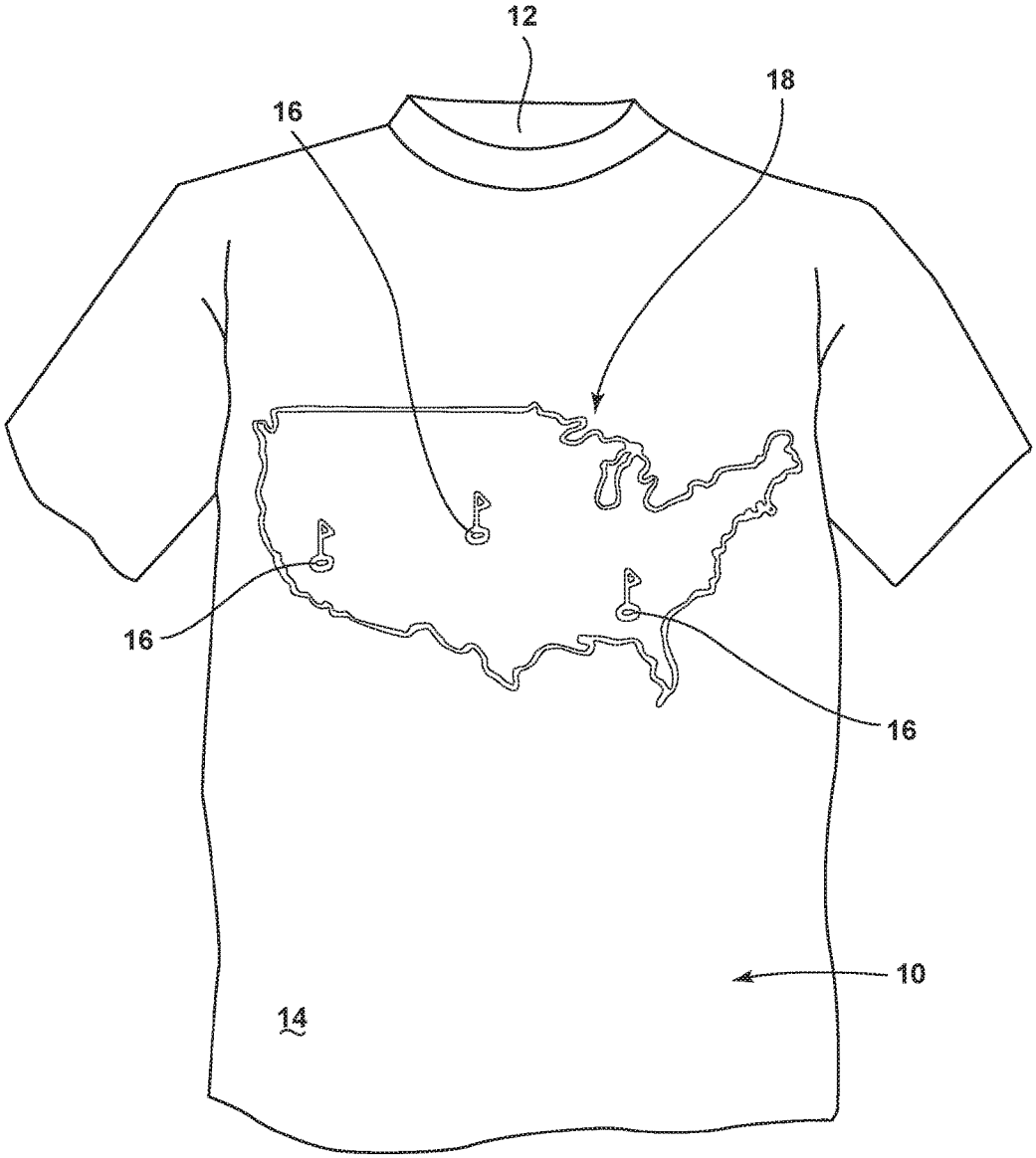
FIG. 6 is a front elevation view of an article of clothing having personalized indicia according to aspects of the present disclosure, showing golf courses of the United States which have been traveled to by an individual.
Figure 7:
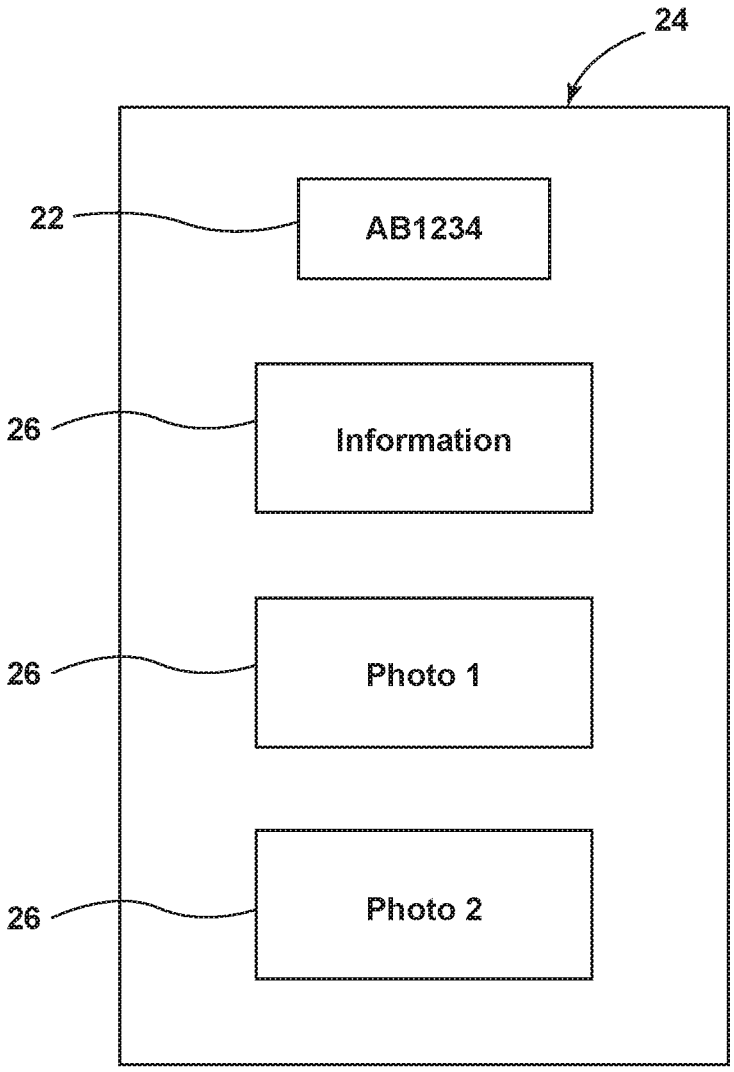
FIG. 7 is a schematic representation of a data record maintained on an electronic information database according to aspects of the present disclosure.
Figure 8:
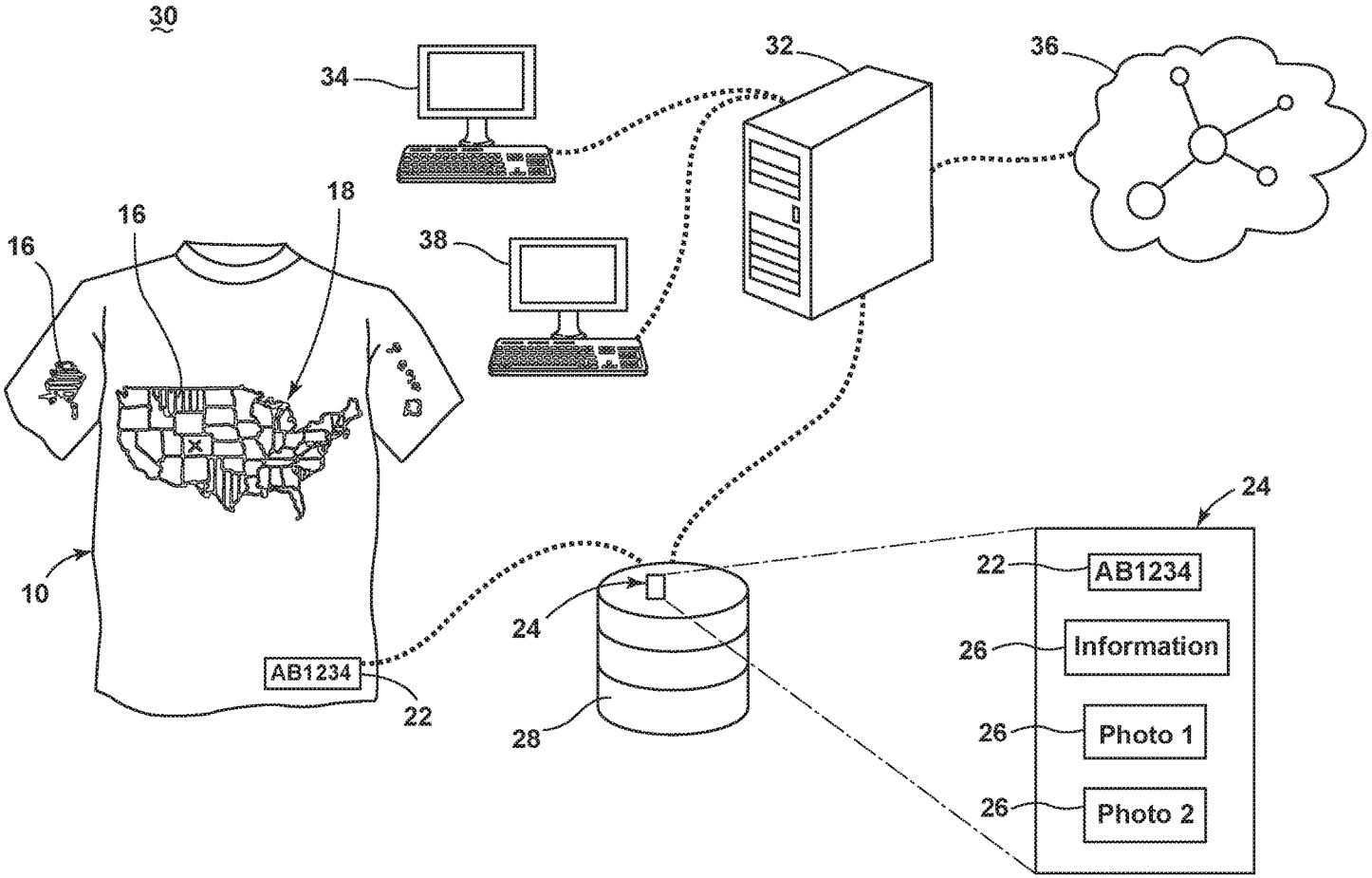
FIG. 8 is a schematic view of a system according to aspects of the present disclosure for associating a personalized article of clothing displaying travel history with information related to a person wearing the personalized article of clothing.

Referring now to FIGS. 4 and 8, the article of clothing 10 may also comprise a unique identifier 22 that corresponds to a data record 24 maintained on an electronic information database. The unique identifier 22, in one embodiment, may be alphanumeric (i.e., a model number, a serial number, and the like, such as 1, 02, 003, 1234, AB1234, etc.). It will be understood that the data record 24 may include information 26, such as personal information (e.g., name, address, age, sex, phone number, email address, marital status, educational background, employment background, hobbies, interests, birthdate, etc.), pictures, photos, and/or information associated with the individual wearing the article of clothing 10. The information 26 may pertain to the travel history of the individual as identified on the article of clothing 10. It is also contemplated that the identifier 22 may be associated with, for example, MySpace, Facebook, and/or other informational social networking interfaces and associated databases.

As is best shown in FIGS. 1-7 collectively, the present disclosure is also directed to a method for producing the article of clothing having the personalized indicia 16 pertaining to the travel history of an individual. The method may comprise the steps of: providing the article of clothing 10 having the inner surface 12 and the outer surface 14, wherein the outer surface 14 comprises an area adapted to contain the personalized indicia 16, and associating the personalized indicia 16 with the area adapted to contain the same which corresponds to a location traveled to or on by the individual and, in turn, personalizing the article of clothing 10 for the individual. The method may also include the step of associating additional personalized indicia 16 with the area adapted to contain the same which corresponds to locations traveled to or on by the individual and, in turn, further personalizing the article of clothing for the individual. The method may also comprise the step of associating the unique identifier 22 with the article of clothing 10, wherein the identifier corresponds to the 24 data record maintained on an electronic information database so that a person may observe the data record 24 in the context of the individual who adorned the article of clothing 10.

By way of additional example, the present disclosure may be directed to the article of clothing 10 having the personalized indicia 16 pertaining to the travel history of an individual, and the article of clothing 10 may have the inner surface 12 and the outer surface 14, wherein the outer surface 14 comprises the base indicia 18 having a first area (e.g., the United States), and at least one region defined by and having at least a second area (e.g., a state of the United States) which is less than or equal to the first area. The personalized indicia 16 associated with the at least one region of the outer surface 14 of the article of clothing 10 may substantially correspond to the at least second area, and the personalized indicia 16 operates to change the appearance of at least a portion of the outer surface 14 of the article of clothing 10 when the personalized indicia 16 is associated with at least a portion of the outer surface 14 of the article of clothing 10 so as to create a personalized article of clothing.

Referring now to FIG. 8, the article of clothing 10 with the personalized indicia 16 and the unique identifier 22 and the database 28 with the data record 24 may form a system 30 for associating the personalized article of clothing 10 with information related to the person wearing the article of clothing 10. The system 30 may include other elements, which will be described below. With the system 30, a person may wear or otherwise be associated with the article of clothing 10, while another person, an observer of the article of clothing 10, can ascertain from the personalized indicia 16 and from the data record 24, which he or she may access with the unique identifier 22, information about the travel history of the person and, possibly, information about the person not related to the travel history (e.g., personal information, such as—name, address, age, sex, phone number, email address, marital status, educational background, employment background, hobbies, interests, birthdate, etc.).

To use the system 30, the article of clothing 10 is personalized for a person associated with the article of clothing 10, such as the wearer of the article of clothing 10, by applying the personalized indicia 16. The personalized indicia 16 communicate the travel history of the person, which may be geographic locations to which the person has traveled and may be applied by the person or by another person or company, such as a producer of the article of clothing 10. When the article of clothing 10 displays more than one of the personalized indicia 16, the aggregate of the personalized indicia 16 corresponds to the travel history of the person associated with the article of clothing. The number and types of the personalized indicia 16 applied to the article of clothing 10 may be updated, such as by adding more of the personalized indicia 16, as the travel history of the person changes with time.

The article of clothing 10 also displays the unique identifier 22 that is assigned to and is specific to the person. The unique identifier 22 may be assigned by selection of the unique identifier 22 by the person, or the unique identifier 22 may be assigned by another person or company, such as the producer of the article of clothing 10. The unique identifier 22 may be provided on the article of clothing 10 when the person purchases the article of clothing 10. In another embodiment, the unique identifier 22 may be provided separately from the article of clothing 10, such as in a separate package that comes with the article of clothing 10 or that is provided separately from the article of clothing 10, either at the time of purchase of the article of clothing 10 or at a later date. Further, when the unique identifier 22 is alphanumeric, the unique identifier 22 may be randomly assigned/selected or may be a particular username. As alternatives, the unique identifier 22 may be in the form of, for example, a barcode, a RFID (radio frequency identification) tag, or QR (quick response) two-dimensional barcode that can be scanned with a scanning device, including mobile computing devices having scanning applications.

As mentioned above, the unique identifier 22 may correspond to the data record 24 maintained on the database 28. The data record 24 may be accessed by the person to establish and/or update the information 26 in the data record 24 according to the travel history or personal information of the person. The information 26 related to the travel history of the person may include, for example, a list or graphical representation (i.e., a map) of places to which the person has traveled and/or would like to travel, photographs taken during travels (with or without descriptive captions and with or without embedded GPS data related to where the photograph was taken), a travel log or journal, a calendar with dates of previous travels and future travels, and the like. The database 28 may be in communication with a server 32 or other computing device that enables access of the database 28 over the Internet, such as through a website or application accessible by a computer 34, examples of which include, but are not limited to, a desktop computer, a laptop computer, a workstation, and a mobile computing device, such as a cellular phone and a tablet. In this manner, the person can use the computer 34 to establish and/or maintain the data record 24. The data record 24 on the database 28 may be accessed by the person in any suitable manner and is not limited to the particular manner described above and shown in FIG. 8.

By displaying the unique identifier 22 on the article of clothing 10, another person, such as an observer of the article of clothing 10, may also access the data record 24 to view the information 26 and associate the information 26 with the person wearing the article of clothing 10. In one example, the observer may view the information 26 through a social network interface 36, which may have access to the data record 24 through the server 32 or other suitable communication system(s). The observer may be required to enter the unique identifier 22 to be given access to the information 26 and, optionally, a password provided by the person wearing the article of clothing 10. When the unique identifier 22 is graphical (i.e., not alphanumeric), the observer may scan the unique identifier 22 with a scanning device, including a mobile computing device, and upload the scanned information or image to access the data record 24. The information 26 may be displayed to the observer in any suitable manner. As one example, the social network interface 36 may be for a social network dedicated solely to travel. As another example, the social network interface 36 may be for a general social network, such as the aforementioned Facebook and MySpace, which provides a virtual space for users to share travel information. Alternatively, the observer may be able to view the information directly through a computer 38 rather than via the social network interface 36, and the person associated with the article of clothing 10 may also access the data record 24 via the social network interface 36 if desired. The computer 38 may be any suitable type of computing device, examples of which include, but are not limited to, a desktop computer, a laptop computer, a workstation, and a mobile computing device, such as a cellular phone and a tablet.

As explained in the description of the system 30 and its use, the system 30 may be employed to implement a method for associating the personalized article of clothing 10 with information related to the person associated with the article of clothing 10. In one embodiment, the method may comprise providing the article of clothing 10 for personalization with at least one of the personalized indicia 16 to communicate the travel history of the person associated with the article of clothing 10, assigning the unique identifier 22 specific to the person associated with the article of clothing 10 and providing the unique identifier 22 on the article of clothing 10, and associating the unique identifier 22 with the data record 24 maintainable by the person associated with the article of clothing 10. The method may further include providing access to the information in the data record via a social networking interface when the unique identifier is provided to the social network interface. Further, the method may involve providing a cover to selectively conceal the unique identifier or providing the unique identifier on an inside surface of the article of clothing.

Figure 9A:
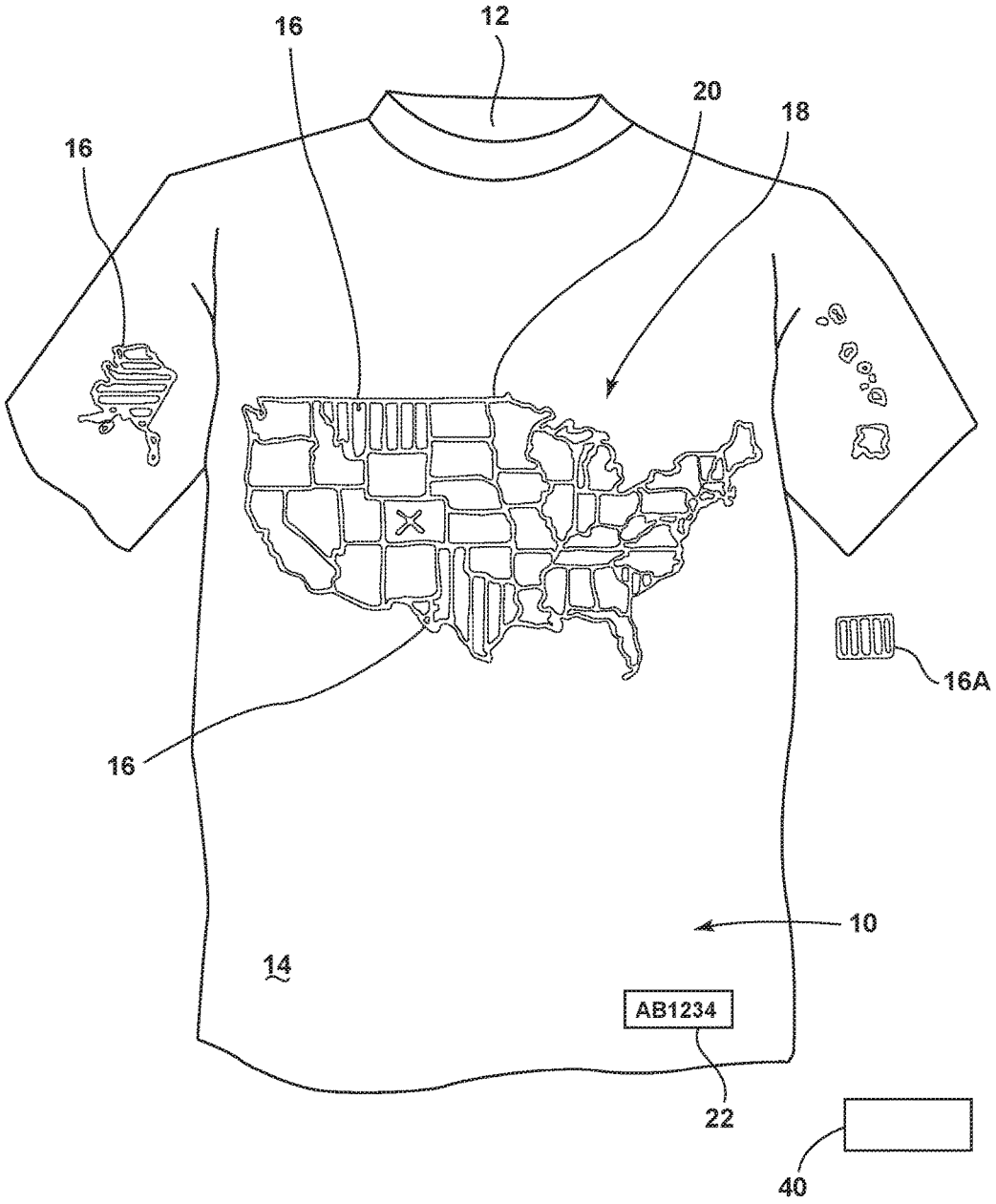
FIG. 9A is a front elevation view of an article of clothing similar to that of FIG. 1 with the addition of a unique identifier on the article of clothing and a cover for selectively displaying the unique identifier, wherein the cover is removed from the unique identifier.
Figure 9B:
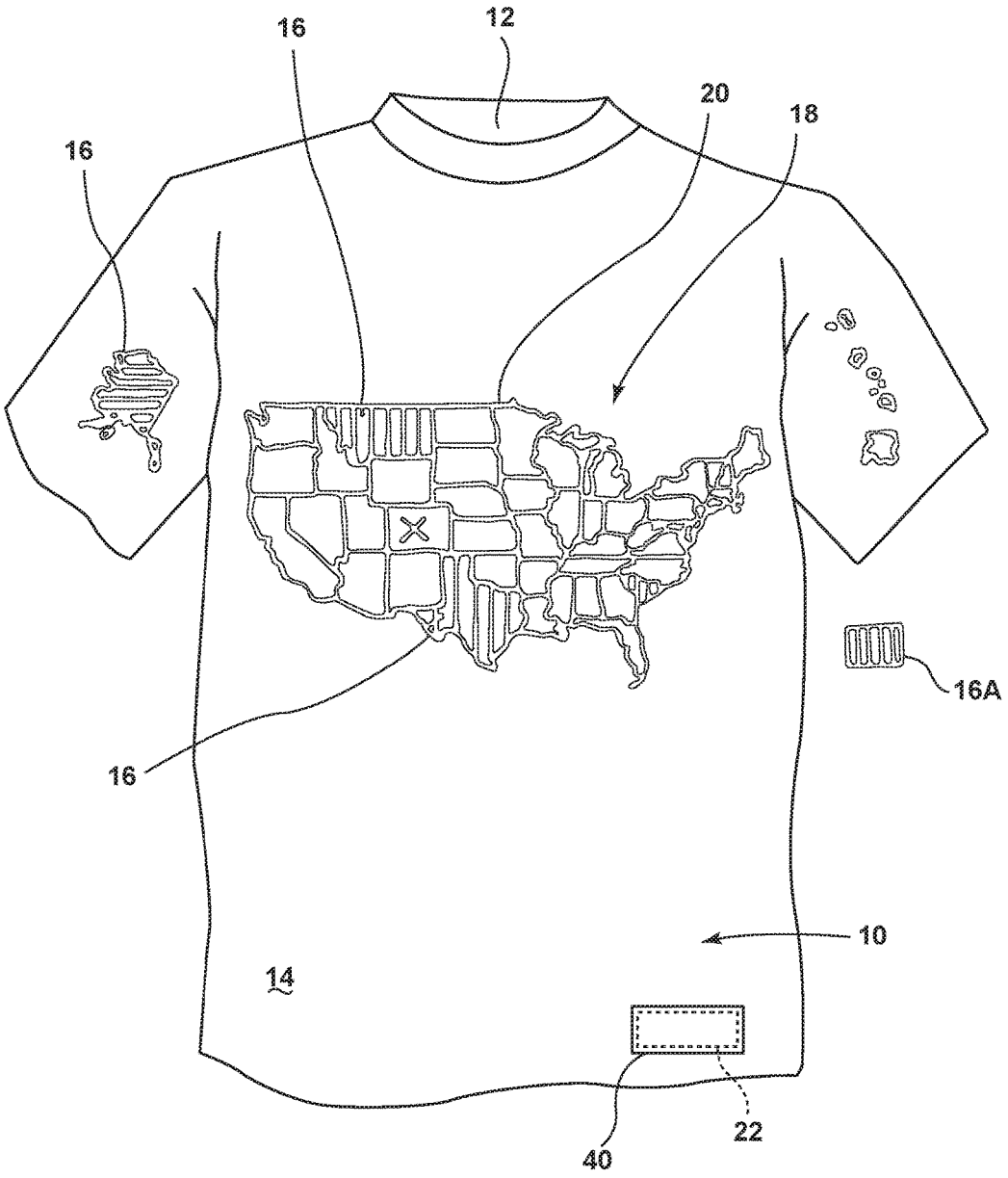
FIG. 9B is a front elevation view of the article of clothing of FIG. 9A, wherein the cover is applied to the article of clothing over the unique identifier to conceal the unique identifier.

Referring now to FIGS. 9A and 9B, the article of clothing 10 may be configured to selectively display the unique identifier 22. The person wearing the article of clothing, in some instances, may desire to share the unique identifier 22 only with certain other people, such as friends and family, so as to allow only those certain other people access to the information 26 on the data record 24. In the embodiment of FIGS. 9A and 9B, the unique identifier 22 may be selectively concealed with a cover 40 releasably secured to the article of clothing 10 on top of the unique identifier 22, such as by the aforementioned hook and loop fasteners or magnetic fasteners or with any other type of reusable attachment means. When the person wishes to display the unique identifier 22, the person may remove the cover 40, as shown in FIG. 9A, and then place the cover 40 back on the article of clothing 10 when the person wishes to conceal and block visual access to the unique identifier 22, as shown in FIG. 9B. The cover 40 may be a completely removable panel, as shown in the figures, or may be in the form of a flap where the cover 40 remains attached to the article of clothing 10, such as along one edge, when a portion of the cover 40 that is not attached is lifted to reveal the unique identifier 22 when desired. Further, the unique identifier 22 itself may be removable from the article of clothing 10, if desired, such as for selective display of the unique identifier 22 or locating/moving the unique identifier 22 at/to a desired position on the article of clothing 10.

Figure 10:
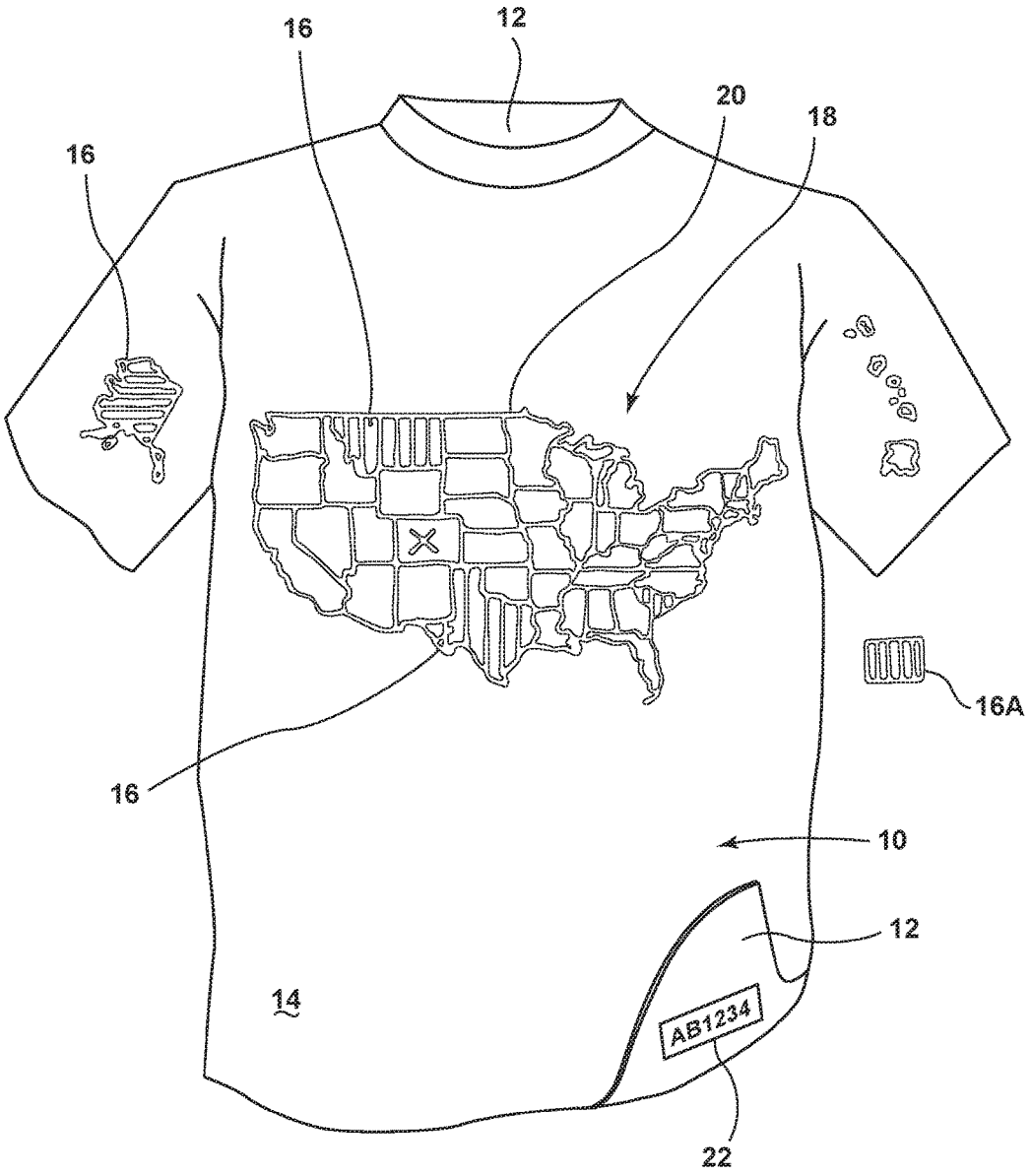
FIG. 10 is a front elevation view of an article of clothing similar to that of FIG. 1 with the addition of a unique identifier on an inside surface of the article of clothing.

As shown in FIG. 10, the unique identifier 22 may optionally be located on the inside surface 12 of the article of clothing 10, which also enables selective display of the unique identifier 22. To share the unique identifier 22, the person wearing the article of clothing 10 simply reveals the inside surface 12 that contains the unique identifier 22, such as by folding back the bottom of the shirt in the example of FIG. 10. Other exemplary locations for the unique identifier 22 on the inside surface 12 of the article of clothing 10 when the article of clothing 10 is a shirt include, but are not limited to, the inside of the sleeve and the inside of the collar. When the unique identifier 22 is on the inside surface 12, the unique identifier 22 may be permanently or removably attached to/disposed on the inside surface 12.

Figure 11:
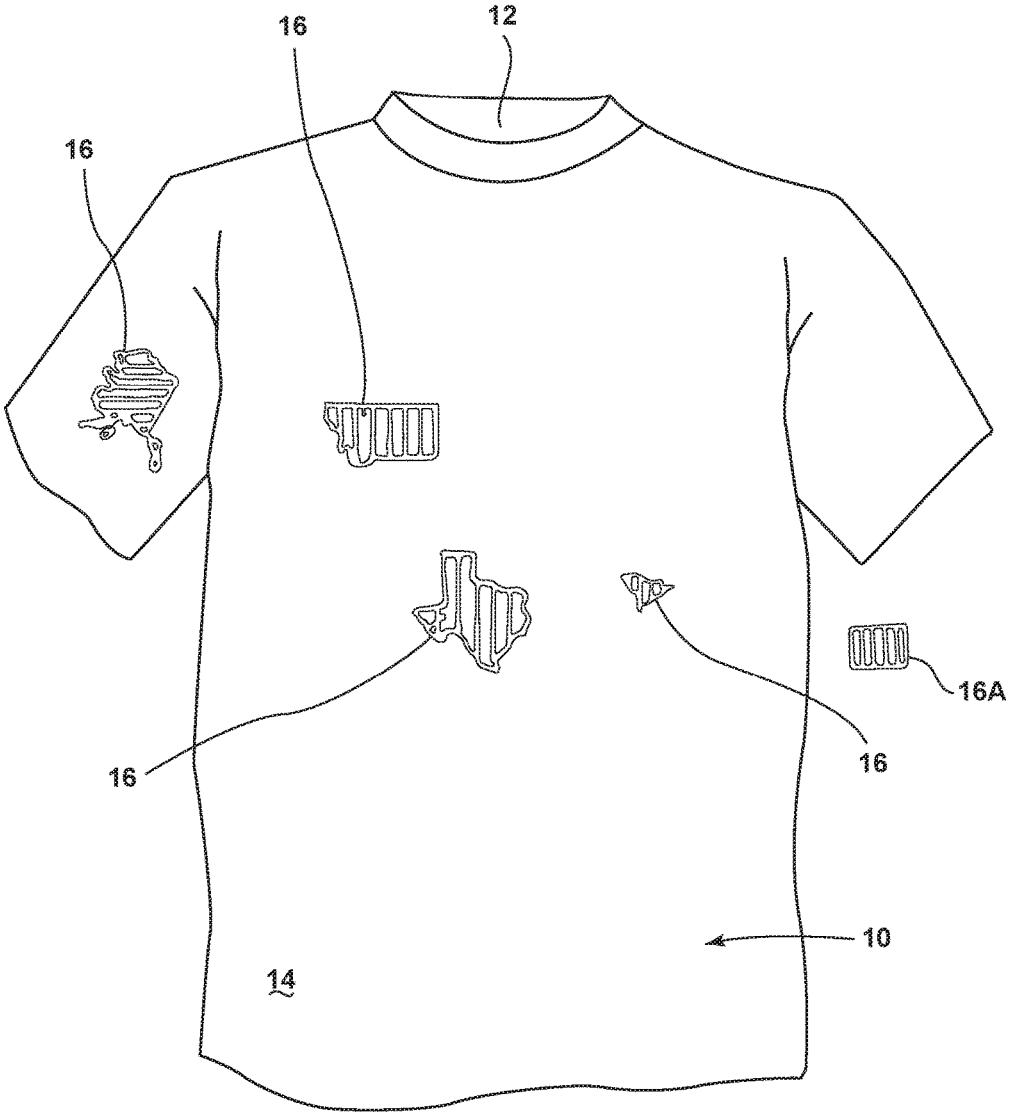

The article of clothing 10 in the above system 30 may include the base indicia 18 in addition to the personalized indicia 16, as explained with respect to FIG. 1. When the article of clothing 10 includes the base indicia 18, the base indicia 18 may have a first area, and in the example where the base indicia 18 is a country, the first area may correspond to the area defined by the outline of the country. The base indicia 18 may also include at least one second area that is less than the first area, and in the same example, the second area(s) may correspond to the states within the country. Other examples of the first and second areas include, but are not limited to, continents and countries, and the Earth and continents, respectively. The first and second areas may also be thought of as regions and sub-regions, respectively, and the sub-regions may optionally be defined by a border on the base indicia 18 with the personalized indicia 16 having a shape as defined by the border. As shown in FIG. 11, the article of clothing 10 for the system 30 may optionally omit the base indicia 18 and include only the personalized indicia 16 to communicate the travel history of the person.

The above description provides several examples of the manner in which the base indicia 18 and the personalized indicia 16 may be applied to or otherwise disposed on the article of clothing 10. These examples also apply to the application of the unique identifier 22. It is also within the scope of the present disclosure to employ methods other than those listed above for applying the base indicia 18, the personalized indicia 16, and the unique identifier 22 to the article of clothing 10 and/or to each other.

Further, the base indicia 18, the personalized indicia 16, and the unique identifier 22 may also be thought of as appliqués. Appliqués are defined as ornamentation that is sewn on to or otherwise applied or attached to a piece of material. As the base indicia 18, the personalized indicia 16, and the unique identifier 22 are items that are applied to the article of clothing 10, they constitute base, personalized, and identifier appliqués 18, 16, 22 that change the appearance of the article of clothing 10 and contribute to the structure of the article of clothing 10.

This written description uses examples to disclose the invention, including the best mode, and also to enable any person skilled in the art to practice the invention, including making and using any devices or systems and performing any incorporated methods. While the invention has been specifically described in connection with certain specific embodiments thereof, it is to be understood that this is by way of illustration and not of limitation, and the scope of the appended claims should be construed as broadly as the prior art will permit.

What is claimed is:

1. A system for associating an article of clothing personalized according to a travel history, comprising:

a first article of clothing having at least one first indicium in the form of a map displayed on the first article of clothing and the map personalized to provide a travel history of a person associated with the first article of clothing by indicating locations on the map the person has traveled to by way of overlying a subset of the map with a set of first personalized indicia, and a first identifier disposed on the first article of clothing;

a second article of clothing having at least one second indicium in the form of a map displayed on the second article of clothing and the map personalized to provide a travel history of a person associated with the second article of clothing by indicating locations on the map the person has traveled to by way of overlying a subset of the map with a set of second personalized indicia, and a second identifier disposed on the second article of clothing;

a first data record corresponding to the first indicium and the set of first personalized indicia of the first article of clothing and a second data record corresponding to the second indicium and the set of second personalized indicia of the second article of clothing and where the first data record and the second data record are configured to associate the respective identifier with the travel history of the corresponding person; and a database configured to store the first data record and the second data record and to allow access to at least one of the first data record or the second data record through the corresponding identifier;

wherein the first identifier is unique from the second identifier, and wherein the first data record includes a picture of the person associated with the first article of clothing from at least one of the locations on the map overlain with the set of first personalized indicia and wherein the second data record includes a picture of the person associated with the second article of clothing from at least one of the locations on the map overlain with the set of second personalized indicia.

2. The system of claim 1 wherein the map comprises at least one of a state, a country, a continent, a city, a planet, a territory, a province, a city, or a region.

3. The system of claim 1 wherein the at least one first indicium comprises at least one base indicium.

4. The system of claim 3 wherein a first area of the at least one base indicium is the map shaped as at least one of a country, a continent, or Earth, and the at least one of the set of first personalized indicia is respectively shaped as one of a state of the country, a country of the continent, or a continent of the Earth.

5. The system of claim 4 wherein a second area of the at least one of the set of first personalized indicia is less than or equal to the first area.

6. The system of claim 4 wherein the at least one of the set of first personalized indicia is configured to be applied to the first area.

7. The system of claim 3 wherein the at least one base indicium or at least one of the set of first personalized indicia form appliqués configured to be applied to the first article of clothing.

8. The system of claim 7 wherein the at least one of the set of personalized indicia is configured to be applied to the at least one base indicium.

9. The system of claim 3 wherein at least one of the set of personalized indicia comprises a color different from a color of the article of clothing or the at least one base indicium, so that the color of the at least one of the set of personalized indicia distinguishes the at least one of e set of personalized indicia from the first article of clothing or the at least one base indicium.

10. The system of claim 3, wherein the set of first personalized indicia and the second set of personalized indicia are releasably attached to the respective first and second article of clothing.

11. The system of claim 3 wherein at least one of the set of personalized indicia is configured to visually communicate a geographic location where the person associated with the first article of clothing has traveled, and an aggregate of the at least one personalized indicium is configured to visually communicate a geographic history of the person associated with the first article of clothing.

12. The system of claim 11 wherein the geographic history includes an actual travel history of the person associated with the first article of clothing.

13. The system of claim 1, wherein the at least one first indicium and the at least one second indicium and releasably attached to the respective first and second article of clothing.

14. The system of claim 1 wherein the geographic history includes an actual travel history of the person associated with the first article of clothing.

15. The system of claim 1 wherein at least one of the first data record or the second data record includes at least one of the geographic location where the person associated with the respective first or second article of clothing has traveled, or the geographic history of the person associated with the respective first or second article of clothing.

16. The system of claim 1 wherein at least one of the first identifier or the second identifier is alphanumeric.

17. The system of claim 1, wherein at least one of the first identifier or the second identifier is releasably attached to the respective first and second article of clothing.

* * * * *